US009358542B2

(12) United States Patent
Tyagi et al.

(10) Patent No.: US 9,358,542 B2
(45) Date of Patent: Jun. 7, 2016

(54) MAGNETIC TUBE RACK

(71) Applicants: Bio-Rad Laboratories, Inc., Hercules, CA (US); BioCanal, Wuxi, Jiangsu (CN)

(72) Inventors: Amandeep Tyagi, Hercules, CA (US); James Xu, Hercules, CA (US); Shengjue Lu, Wuxi (CN); Haihui Yuan, Wuxi (CN)

(73) Assignee: Bio-Rad Laboratories, Inc., Hercules, CA (US)

( * ) Notice: Subject to any disclaimer, the term of this patent is extended or adjusted under 35 U.S.C. 154(b) by 0 days.

(21) Appl. No.: 14/317,969

(22) Filed: Jun. 27, 2014

(65) Prior Publication Data

US 2015/0336102 A1 Nov. 26, 2015

(30) Foreign Application Priority Data

May 22, 2014 (CN) ..... 2014 2 0264902 U

(51) Int. Cl.
*B01L 9/06* (2006.01)
*B66F 11/00* (2006.01)

(52) U.S. Cl.
CPC . *B01L 9/06* (2013.01); *B66F 11/00* (2013.01); *B01L 2200/02* (2013.01); *B01L 2300/0851* (2013.01)

(58) Field of Classification Search
CPC B01L 9/06; B01L 2200/023; B01L 2200/025
USPC ..... 422/561, 562
See application file for complete search history.

(56) References Cited

U.S. PATENT DOCUMENTS

| | | | | |
|---|---|---|---|---|
| 4,411,868 | A * | 10/1983 | Noack | 422/562 |
| 4,895,650 | A | 1/1990 | Wang | |
| 5,571,481 | A * | 11/1996 | Powell et al. | 422/562 |
| 6,193,892 | B1 * | 2/2001 | Krueger et al. | 210/695 |
| 2011/0031168 | A1 * | 2/2011 | Ellis et al. | 209/223.1 |
| 2013/0209995 | A1 | 8/2013 | Andrulat et al. | |

OTHER PUBLICATIONS

Extended European Search Report for EP patent application No. 15168625.0, mailed on Sep. 28, 2015, 7 pages.
DynaMag, 2012, pp. 1-2; LifeTechnologies Corporation.
"PureProteome™ Magnetic Stand, 8-well Cat. No. LSKMAGS08"; 2010; pp. 1-2; Millipore Corporation.

* cited by examiner

*Primary Examiner* — Paul Hyun
(74) *Attorney, Agent, or Firm* — Kilpatrick Townsend And Stockton LLP

(57) ABSTRACT

A system for holding sample tubes used in immunoprecipitation and similar laboratory techniques. A rack comprises top and bottom plates spaced apart from each other and defining rows of holes to receive the sample tubes and hold the sample tubes in a pair of spaced-apart rows. A magnet holder is configured to slide between the top and bottom plates and between the two parallel rows of sample tubes such that when the magnet holder is fully inserted between the rows of sample tubes, magnets held by the magnet holder align with the sample tubes in the two parallel rows.

13 Claims, 3 Drawing Sheets

MAGNETIC TUBE RACK

This application claims priority to Chinese Utility Model application 201420264902.1, filed May 22, 2014.

BACKGROUND OF THE INVENTION

Immunoprecipitation is a laboratory technique for isolating a protein from a solution. In one technique, paramagnetic beads are coated with antibodies specific to the protein of interest, and the beads are introduced into the solution and the proteins of interest bind to the antibodies on the beads. A magnet is used to retain the beads in a localized part of the container in which the solution is held. The solution is then pipetted or poured out of the container, leaving the beads in the container and coated with the protein of interest. The magnet and the container can then be separated so that the beads can be easily removed from the container for further processing.

Typically, multiple containers are handled in a group, in order to increase the efficiency of the isolation. Improvements are needed in devices for managing such groups of containers for immunoprecipitation and other techniques.

BRIEF SUMMARY OF THE INVENTION

According to one aspect, a system for holding sample tubes comprises a top plate defining a first plurality of holes. Each of the first plurality of holes is a though hole through the top plate and is sized for accommodating an outer diameter of a respective sample tube. The system also comprises a bottom plate defining a second plurality of holes. Each of the second plurality of holes is sized to accommodate a tip of a respective sample tube. The first and second pluralities of holes are positioned to cooperatively hold the sample tubes in a pair of parallel rows. The system also comprises a removable magnet holder configured to slide between the top plate and the bottom plate and between the two rows of sample tubes. The magnet holds a plurality of magnets that, when the magnet holder is fully inserted between the rows of sample tubes, align with the sample tubes in the parallel rows. In some embodiments, the system further comprises a pair of end plates to which the top and bottom plates are attached at opposing ends, and that hold the top and bottom plates in spaced-apart relation. In some embodiments, a first of the two endplates defines an opening through which the magnet holder slides when the magnet holder is inserted between the rows of sample tubes. In some embodiments, the system further comprises a ferromagnetic retainer affixed to the second of the two endplates and aligned with a distal end of the magnet holder, such that the magnet nearest the distal end of the magnet holder and the ferromagnetic retainer, by magnetic attraction, cooperate to removably retain the magnet holder in position between the rows of sample tubes. Each of the second plurality of holes may be sized to engage a tapered tip of a respective sample tube in a press fit. In some embodiments, each of the second plurality of holes includes a round portion sized to engage a tapered tip of a respective sample tube in a press fit and an oblong portion having a width less than the diameter of the round portion, the oblong portion extending from the round portion toward an outside edge of the bottom plate. The first and second pluralities of holes may be sized to engage micro-centrifuge sample tubes each having a nominal capacity of 1.5 ml.

According to another aspect, a method comprises inserting a plurality of sample tubes into a rack. The rack includes a top plate defining a first plurality of holes and includes a bottom plate spaced apart from the top plate. The bottom plate defines a second plurality of holes, the first and second pluralities of holes cooperating to hold the sample tubes in a pair of parallel rows. The method further comprises sliding a magnet holder between the top and bottom plate and between the two parallel rows such that a plurality of magnets held by the magnet holder align with the sample tubes in the parallel rows. In some embodiments, the method further comprises placing the rack in a rest position, and removing the magnet holder without disturbing the rack from its rest position.

According to another aspect, a system for holding sample tubes comprises a plurality of sample tubes, and a rack. The rack includes a top plate defining a first plurality of holes and includes a bottom plate spaced apart from the top plate. The bottom plate defines a second plurality of holes, the first and second pluralities of holes cooperating to hold the sample tubes in a pair of parallel rows. The system further includes a magnet holder holding a plurality of magnets, such that when the magnet holder is inserted between the top and bottom plates and between the parallel rows of tubes, the magnets align with the sample tubes in the parallel rows. In come embodiments, each of the sample tubes has a nominal capacity of 1.5 ml.

According to another aspect, a system for holding sample tubes comprises top and bottom plates spaced apart from each other and defining rows of holes to receive the sample tubes and hold the sample tubes in a pair of spaced-apart rows. The system further comprises a magnet holder configured to slide between the top and bottom plates and between the two parallel rows of sample tubes such that when the magnet holder is fully inserted between the rows of sample tubes, magnets held by the magnet holder align with the sample tubes in the two parallel rows. In some embodiments, when the magnet holder is inserted between the rows of sample tubes, no material is disposed between the magnets and the sample tubes. In some embodiments, the magnet holder can be removed from the rack without disturbing the position of the rack. In some embodiments, the holes in the bottom plate are sized to engage the sample tubes in a press fit, such that the sample tubes remain in fixed positions in relation to the rack during laboratory handling. In some embodiments, each of the holes in the bottom plate defines an oblong portion extending toward an outer edge of the bottom plate and enabling visual inspection of the tip of a sample tube inserted into the respective hole in the bottom plate.

DETAILED DESCRIPTION OF THE INVENTION

In prior systems used for immunoprecipitation, a rack holds a plurality of sample tubes above one or more magnets. Separating the magnet from the sample tubes (for freeing the beads after the solution has been removed) involves lifting the rack. In general, it is desirable to minimize the amount of handling that the sample tubes are subjected to.

Figure 1:
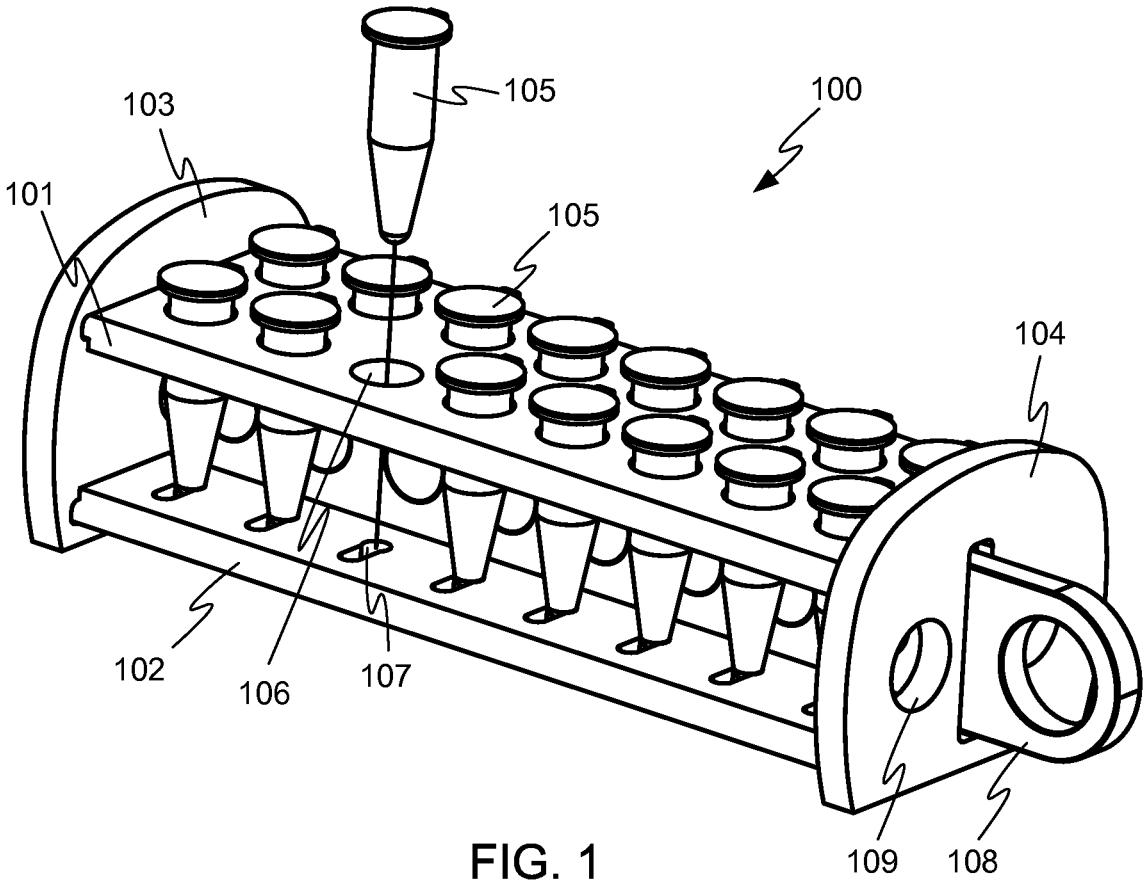
FIG. 1 illustrates a magnetic tube rack in accordance with embodiments of the invention.

FIG. 1. illustrates a magnetic tube rack 100 in accordance with embodiments of the invention. Magnetic tube rack 100 comprises a top plate 101 and a bottom plate 102, held in spaced-apart relation by end plates 103 and 104. Top and bottom plates 101 and 102 and end plates 103 and 104 may be made of any suitable material or combinations of materials, for example polycarbonate, acrylic, ABS, acetal, aluminum, one or more composites, or other materials. Preferably, the materials used in constructing magnetic tube rack 100 are sturdy and easily cleaned. The components of magnetic tube rack 100 may be joined by any suitable method, for example by solvent bonding, by one or more adhesives, using fasteners, or by another technique or combination of techniques.

Magnetic tube rack 100 is configured for handling of a number of sample tubes 105. In the example embodiment of FIG. 1, sample tubes 105 are typical micro-centrifuge tubes having a nominal capacity of 1.5 ml, but it will be recognized that other kinds and sizes of sample tubes may be used in embodiments of the invention.

Figure 2:
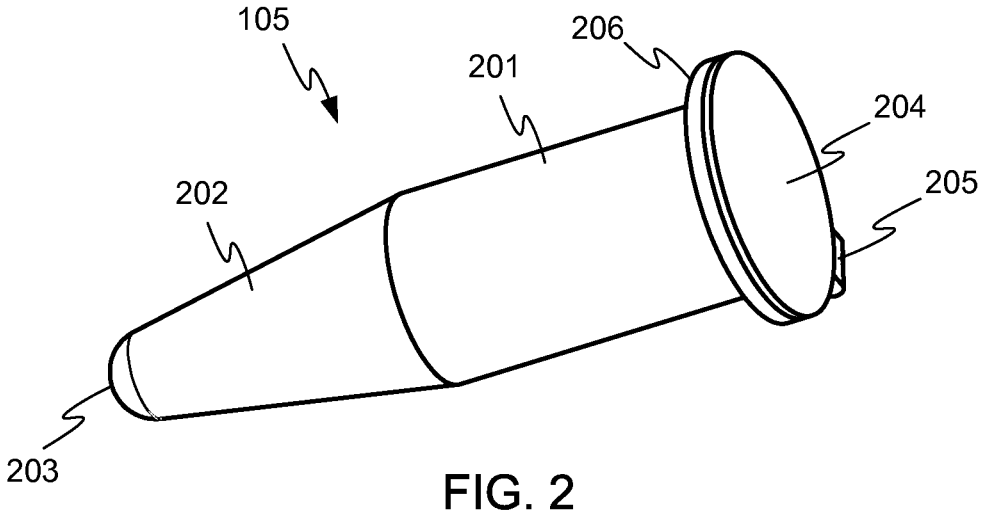
FIG. 2 illustrates a sample tube usable in embodiments of the invention.

FIG. 2 illustrates one of sample tubes 105 in more detail. Sample tube 105 includes a main portion 201 having an outer diameter, and a tapered end portion 202 that tapers to a tip 203. A cap 204 may be integrally formed with the rest of sample tube 105, for example via a living hinge 205 formed during an injection molding process. Cap 204 may be used for closing sample tube 105, and may engage with a flange 206, which extends beyond the outer diameter of main portion 201. Sample tube 105 is typically thin-walled, and made of a polymer such as polypropylene. Sample tube 105 may have a capacity of about 1.5 ml, a main portion 201 diameter of about 10.8 mm, and an overall length of about 41 mm.

Referring again to FIG. 1, upper plate 101 defines a plurality of through holes 106, of a size to accommodate the outer diameter of main portions 201 of sample tubes 105 in a loose fit. In this example, magnetic tube rack 100 is configured to hold 16 sample tubes 105, but other embodiments may accommodate more or fewer sample tubes.

Bottom plate 102 defines a second plurality of holes 107. Holes 107 may be through holes or blind recesses within bottom plate 102. Each of holes 107 is sized to accommodate the tip of its respective sample tube 105. In some embodiments, sample tubes 105 may be pressed into holes 107, so that tapered portions 202 of the sample tubes press into holes 107 and constrain the height of sample tubes 105 within rack 100. This press fit also constrains sample tubes 105 from rotating during normal laboratory handling of rack 100.

A magnet holder 108, described in more detail below, operates in conjunction with magnetic tube rack 100, to facilitate experiments conducted using magnetic tube rack 100. Magnet holder 108 may be made of materials similar to the materials of top, bottom, and end plates 101-104.

A pair of larger openings 109 (only one of which is visible in FIG. 1) may be placed symmetrically in end plate 104, and allow insertion of a pair of larger (50 ml e.g.) centrifuge tubes in lieu of sample tubes 105, for performing procedures on larger samples.

Figure 3:
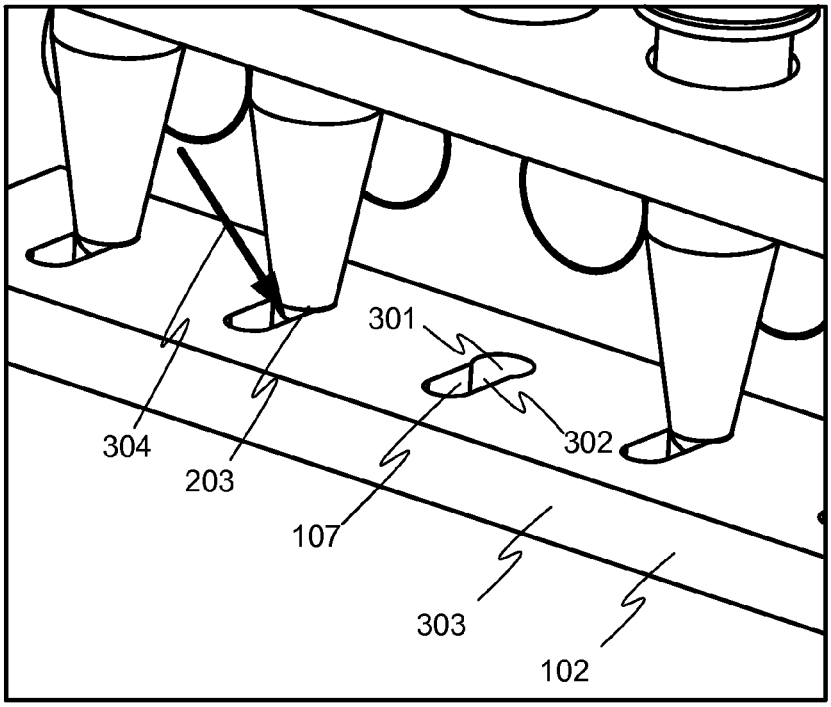
FIG. 3 shows a portion of FIG. 1 in more detail.

FIG. 3 shows a portion of FIG. 1 in more detail, and illustrates other aspects of holes 107, according to embodiments. In this example, each of holes 107 includes a round portion 301 sized to accommodate tip 203 of the respective sample tube 105. Each hole 107 also includes an oblong portion 302, extending toward outer edge 303 of bottom plate 102. Round portion 301 and oblong portion 302 may combine to form a keyhole shape, with the width of oblong portion 302 being less than the diameter of round portion 301. Preferably, oblong portion 302 is narrower than the diameter of round portion 301, so that round portion 301 can provide a press fit to tip 203. Oblong portion 302 may be rectangular, rectangular with a rounded end as shown in FIG. 3, or another suitable shape. Because oblong portion 302 extends toward outer edge 303, it permits viewing of sample tube tip 203 by a user of rack 100, as illustrated by viewing direction arrow 304. This aspect may be especially useful when performing experiments using very small quantities of sample fluids that would otherwise not be visible in tip 203.

Figure 4:
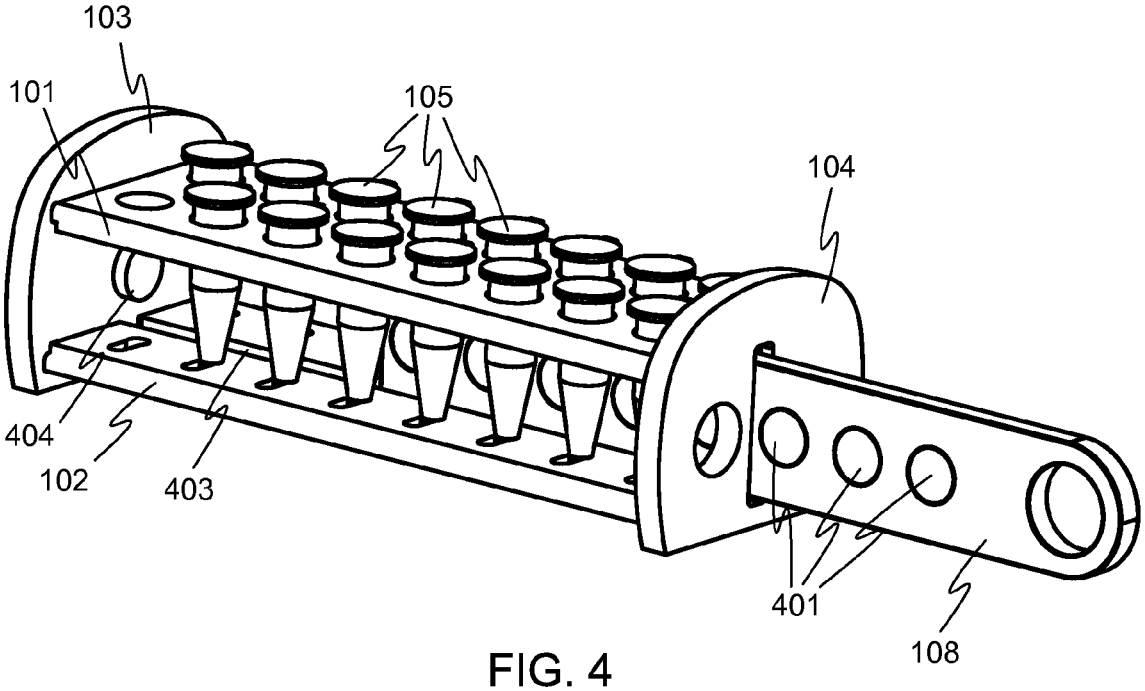
FIG. 4 illustrates the magnetic tube rack of FIG. 1 with a magnet holder partially withdrawn, in accordance with embodiments of the invention.

FIG. 4 illustrates magnetic tube rack 100 with magnet holder 108 partially withdrawn. Magnet holder 108 holds a number of magnets 401 such that when magnet holder 108 is fully inserted into rack 100, the magnets align with tubes 105. Magnets 401 may be affixed to magnet holder 108 in any suitable way, for example by being press fit into holes in magnet holder 108, or by being secured within holes in magnet holder 108 using an adhesive. In one embodiment, magnets 401 are affixed to magnet holder 108 using an ultraviolet-curing adhesive. Preferably, larger openings 109 (shown in FIG. 1) are positioned such that when larger centrifuge tubes are placed in openings 109 and magnet holder 108 is inserted into rack 100, magnets 401 align with the axes of the larger centrifuge tube.

As is visible in FIG. 4, end plate 104 of rack 100 defines an opening 402 through which magnet holder 108 is inserted into rack 100. Top and bottom plates 101 and 102 also include grooves 403 (only the groove on bottom plate 102 is visible). Opening 402 and grooves 403 serve to guide magnet holder 108 into its proper position between the rows of tubes 105.

A ferromagnetic retainer 404 is affixed to end plate 103, opposite opening 402. Retainer 404 serves as a stop or bumper against which magnet holder 108 can rest when it is fully inserted into rack 100, and also provides a mechanism for removably retaining magnet holder 108 in rack 100. Retainer 404 may itself be a magnet, or may simply be a ferromagnetic material to which magnets 401 may be attracted.

Figure 5:
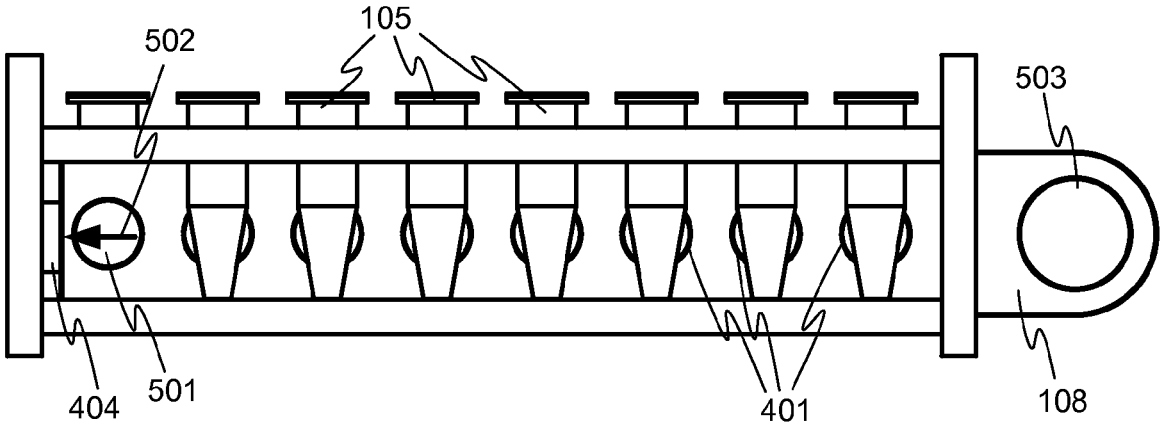
FIG. 5 shows the interaction of the magnet holder and a retainer, in accordance with embodiments of the invention.

FIG. 5 shows the interaction of magnet holder 108 and retainer 404 in more detail, in accordance with embodiments of the invention. In FIG. 5, magnet holder 108 is fully inserted into rack 100, such that magnet holder 108 contacts retainer 404. Additionally, because retainer 404 is ferromagnetic, end magnet 501 is attracted to retainer 404, and provides a force 502 tending to hold magnet holder 108 against retainer 404. As is visible in FIG. 5, in this position, each of the magnets is aligned between two of tubes 105. Force 502 provided by the attraction of end magnet 501 and retainer 404 is sufficient to maintain magnet holder 108 in its fully-inserted position during normal laboratory handling of rack 100, for example if rack 100 is lifted or tilted, but is easily overcome by pulling magnet holder 108 away from retainer 404, for example by pulling via opening 503. Thus, magnet holder 108 can be removed without disturbing rack 100 from a rest position. For example, a user may hold rack 100 down to a bench top while pulling magnet holder 108 away from retainer 404, so that rack 100 does not move during the extraction of magnet holder 108. There is no need to pick up rack 100 to separate it from magnets 401. The lack of disturbance of rack 100 may be beneficial to later process steps. In addition, as is evident in the figures, once magnet holder 108 is inserted into rack 100, there is no material (other than air) between magnets 401 and sample tubes 105 that might interfere with the magnetic attraction between magnets 401 and the beads in sample tubes 105.

In the claims appended hereto, the term "a" or "an" is intended to mean "one or more." The term "comprise" and variations thereof such as "comprises" and "comprising," when preceding the recitation of a step or an element, are intended to mean that the addition of further steps or elements is optional and not excluded. The invention has now been described in detail for the purposes of clarity and understanding. However, those skilled in the art will appreciate that certain changes and modifications may be practiced within the scope of the appended claims.

What is claimed is:

1. A system for holding sample tubes, the system comprising:

a top plate defining a first plurality of holes, each of the first plurality of holes being a through hole through the top plate and sized for accommodating an outer diameter of a respective sample tube;

a bottom plate defining a second plurality of holes, each of the second plurality of holes sized to accommodate a tip of a respective sample tube, wherein the first and second pluralities of holes are positioned to cooperatively hold the sample tubes in a pair of parallel rows;

a pair of end plates to which the top and bottom plates are attached at opposing ends, and that hold the top and bottom plates in spaced-apart relation; and a removable magnet holder configured to slide between the top plate and the bottom plate and between the two rows of sample tubes, the magnet holder holding a plurality of magnets that, when the magnet holder is fully inserted between the rows of sample tubes, align with the sample tubes in the parallel rows;

wherein a first of the two endplates defines an opening through which the magnet holder slides when the magnet holder is inserted between the rows of sample tubes.

2. The system of claim 1, further comprising a ferromagnetic retainer affixed to the second of the two endplates and aligned with a distal end of the magnet holder, such that the magnet nearest the distal end of the magnet holder and the ferromagnetic retainer, by magnetic attraction, cooperate to removably retain the magnet holder in position between the rows of sample tubes.

3. The system of claim 1, wherein each of the second plurality of holes is sized to engage a tapered tip of a respective sample tube in a press fit.

4. The system of claim 1, wherein each of the second plurality of holes includes a round portion sized to engage a tapered tip of a respective sample tube in a press fit and an oblong portion having a width less than the diameter of the round portion, the oblong portion extending from the round portion toward an outside edge of the bottom plate.

5. The system of claim 1, wherein the first and second pluralities of holes are sized to engage micro-centrifuge sample tubes each having a nominal capacity of 1.5 ml.

6. The system of claim 1, wherein one of the end plates further defines one or more holes larger than the holes in the top plate, each of the holes in the end plate configured to receive a respective centrifuge tube having a capacity of at least 50 ml.

7. A method, comprising:

inserting a plurality of sample tubes into a rack, the rack including a top plate defining a first plurality of holes and including a bottom plate spaced apart from the top plate, the bottom plate defining a second plurality of holes, the first and second pluralities of holes cooperating to hold the sample tubes in a pair of parallel rows;

sliding a magnet holder between the top and bottom plate and between the two parallel rows such that a plurality of magnets held by the magnet holder align with the sample tubes in the parallel rows;

placing the rack in a rest position; and removing the magnet holder without disturbing the rack from its rest position.

8. A system for holding sample tubes, the system comprising:

a plurality of sample tubes;

a rack including a top plate defining a first plurality of holes and including a bottom plate spaced apart from the top plate, the bottom plate defining a second plurality of holes, the first and second pluralities of holes cooperating to hold the sample tubes in a pair of parallel rows, the rack further including first and second end plates to which the top and bottom plates are attached at opposing ends, the first and second end plates holding the top and bottom plates in spaced-apart relation; and a magnet holder holding a plurality of magnets, such that when the magnet holder is inserted between the top and bottom plates and between the parallel rows of tubes, the magnets align with the sample tubes in the parallel rows;

wherein a first of the two endplates defines an opening through which the magnet holder slides when the magnet holder is inserted between the rows of sample tubes.

9. The system of claim 8, wherein each of the sample tubes has a nominal capacity of 1.5 ml.

10. A system for holding sample tubes, the system comprising:

top and bottom plates spaced apart from each other and defining rows of holes to receive the sample tubes and hold the sample tubes in a pair of spaced-apart rows; and a magnet holder configured to slide between the top and bottom plates and between the two parallel rows of sample tubes such that when the magnet holder is fully inserted between the rows of sample tubes, magnets held by the magnet holder align with the sample tubes in the two parallel rows;

wherein the magnet holder can be removed from the rack without disturbing the position of the rack.

11. The system of claim 10, wherein when the magnet holder is inserted between the rows of sample tubes, no material other than air is disposed between the magnets and the sample tubes.

12. The system of claim 10, wherein the holes in the bottom plate are sized to engage the sample tubes in a press fit, such that the sample tubes remain in fixed positions in relation to the rack during laboratory handling.

13. The system of claim 12, wherein each of the holes in the bottom plate defines an oblong portion extending toward an outer edge of the bottom plate and enabling visual inspection of the tip of a sample tube inserted into the respective hole in the bottom plate.

* * * * *